United States Patent [19]

Palmer et al.

[11] Patent Number: 4,746,167

[45] Date of Patent: May 24, 1988

[54] PORTABLE, KNOCK-DOWN MASSAGE CHAIR

[76] Inventors: David A. Palmer, 1596 Post St., San Francisco, Calif. 94109; Serge J. L. Bouyssou, 471 Mississippi St., San Francisco, Calif. 94107; James Everett, 600 E. Todd Rd., Santa Rosa, Calif. 95407

[21] Appl. No.: 946,793

[22] Filed: Dec. 29, 1986

[51] Int. Cl.[4] ..... A47C 7/50

[52] U.S. Cl. ..... 297/423; 297/394

[58] Field of Search ..... 297/423, 394, 397, 398, 297/414, 416, 429; 5/434, 435

[56] References Cited

U.S. PATENT DOCUMENTS

| | | | |
|---|---|---|---|
| 1,194,112 | 8/1916 | Wood | 5/435 X |
| 3,037,570 | 6/1962 | Olsen | 297/423 X |
| 3,165,314 | 1/1965 | Clearman et al. | 297/423 X |
| 3,759,511 | 9/1973 | Zinkin et al. | 297/423 X |
| 3,947,903 | 4/1976 | Menke | 297/17 X |
| 3,992,057 | 11/1976 | Studebaker | 297/416 X |
| 4,114,948 | 9/1978 | Perkey | 297/397 |
| 4,453,768 | 6/1984 | Cranford, Jr. et al. | 297/17 X |
| 4,527,829 | 7/1985 | Fanslav et al. | 297/17 |
| 4,589,699 | 5/1986 | Dungan | 297/423 |
| 4,650,249 | 3/1987 | Serber | 297/423 X |
| 4,662,361 | 5/1987 | Patterson | 128/25 R |

FOREIGN PATENT DOCUMENTS

| | | | |
|---|---|---|---|
| 1347216 | 2/1974 | United Kingdom | 297/423 |

*Primary Examiner*—Kenneth J. Dorner
*Assistant Examiner*—José V. Chen
*Attorney, Agent, or Firm*—Howard Cohen

[57] ABSTRACT

A portable, knock-down massage chair includes a generally rectangular case having opposed side walls, each provided with an arcuate cutout extending therein from the upper edge thereof. A lid is hinged to a first end wall of the case and openable to gain access to the interior of the case. Stored within the case are a seat member, a leg rest, an arm rest, a chest support, a face cradle, and a brace assembly. The brace assembly comprises a hinged, two-panel assembly stored adjacent to the bottom of the case, and pivotable therefrom out of the top opening to be joined to the lid to form a rigid triangular support assembly. The chest support and the face cradle are slidably supported on the upper panel of the two-panel assembly, and the seat member is secured atop the side walls adjacent to the second end wall of the case. The leg rest is adapted to be secured within the arcuate cutouts of the side walls in a variable angle fashion, and the arm rest is joined to the lid panel. A person receiving a massage is supported on the seat facing the brace assembly, leaning forward with the chest supported by the chest support, the face on the face cradle, the lower legs on the leg rest, and the arms on the arm rest, so that the back, shoulders, neck, hips and arms are well-presented for massage. A stabilizing member is pivotally joined to the bottom of the case to provide lateral stability to the chair in the erected configuration.

27 Claims, 9 Drawing Sheets

PORTABLE, KNOCK-DOWN MASSAGE CHAIR

BACKGROUND OF THE INVENTION

It appears self-evident that most persons enjoy and appreciate a massage, yet it is a curious fact that very few individuals seek out massage. Despite the sense of relaxation and well-being provided by a good massage, and the relief of tension it provides, the use of massage as an approach to personal health has not become commonplace in western culture. This is probably due in large measure to the societal taboo against interpersonal touching, except in very structured and special situations. For example, a massage is considered to be appropriate in the context of a health club or an athletic locker room, but not in an business office setting or a shopping mall.

The general concept of a massage is that it requires the recipient to disrobe either partially or fully, and to recline completely on a massage table. The massage is usually provided through the use of lubricating oil applied to the skin. The sensual nature of this experience, together with the intimate overtones inferred by many people, determine that massage can be received only in a massage studio or the like. For most individuals, the time involved in going to a massage studio, together with the cost of the massage itself, prohibits receiving a massage. Thus, paradoxically, the basic features of a traditional massage mitigate against the everyday use of massage for stress relief, well-being, and relaxation.

Clearly there is an unmet need for stress relief and relaxation in the lives of a great number of individuals, and thus a need for massage delivered to people in a form that is convenient, inexpensive, non-threatening, and readily available. However, the prior art reveals no means for delivering massage services in a form suitable for mass marketing.

SUMMARY OF THE PRESENT INVENTION

The present invention broadly comprises a knock-down chair construction which is designed to be portable and easily erected and disassembled. A salient feature of the chair construction is that it is adapted particularly to support an individual receiving a massage. The present invention thus is directed toward delivering massage service to massage clients, in office buildings, beauty salons, shopping malls, athletic events, and the like. Massage and bodywork can be marketed by bringing the service to the public, rather than requiring the customers to seek out massage and bodywork on an appointment basis at massage studios.

The portable, knock-down massage chair includes a generally rectangular case having opposed side walls, provided with a pair of arcuate cutouts extending therein from the upper edge thereof. A lid is hinged to a first end wall of the case and openable to gain access to the interior of the case. Stored within the case are a seat member, a leg rest, an arm rest, a chest support, a face cradle, and a brace assembly. The brace assembly comprises a hinged, two-panel assembly stored adjacent to the bottom of the case, and pivotable therefrom out of the top opening to be joined to the lid to form a rigid triangular support assembly. The chest support and the face cradle are supported on the upper panel of the two-panel assembly in slidable, adjustable fashion, and the seat member is secured to the second end wall of the case, resting atop the adjacent side walls. The leg rest is adapted to be secured within the arcuate cutouts of the side walls in a variable angle fashion, and the arm rest is joined to the lid panel and extends laterally therefrom. A stabilizing member is pivotally joined to the bottom of the case to provide lateral stability to the chair in the erected configuration.

A person receiving a massage may be supported on the seat facing the brace assembly, leaning forward with the chest supported by the chest support, the face on the face cradle, the lower legs on the leg rest, and the arms on the arm rest, so that the back, shoulders, neck, hips and arms are well-presented for massage. The angle of the brace assembly and the angle of the seat member are also adjustable so that a person may sit on the seat member facing away from the brace assembly, with their back resting against the chest support and their feet on the ground. The latter position facilitates massage of the shoulders, chest, and legs. Overall, the chair construction permits 90% of a full-body massage in a space approximately 25% of a typical massage table. The portability and quick setup of the invention permit masseurs and bodyworkers to call upon clients, thereby bringing massage services out of speciality locations and into the workplace.

DESCRIPTION OF THE PREFERRED EMBODIMENT

The present invention generally comprises a knock-down chair construction which is designed to be portable and easily erected and disassembled. A salient feature of the chair construction is that it is adapted particularly to support an individual receiving a massage, as shown by way of example in FIG. 2. With regard to FIG. 1, the present invention includes a case 21 which is adapted to serve both as both a supporting base for the assembled chair, and as a storage and carrying container for the various components which are assembled to the supporting base to facilitate the seating and support of a person thereon.

Figures 1, 2:
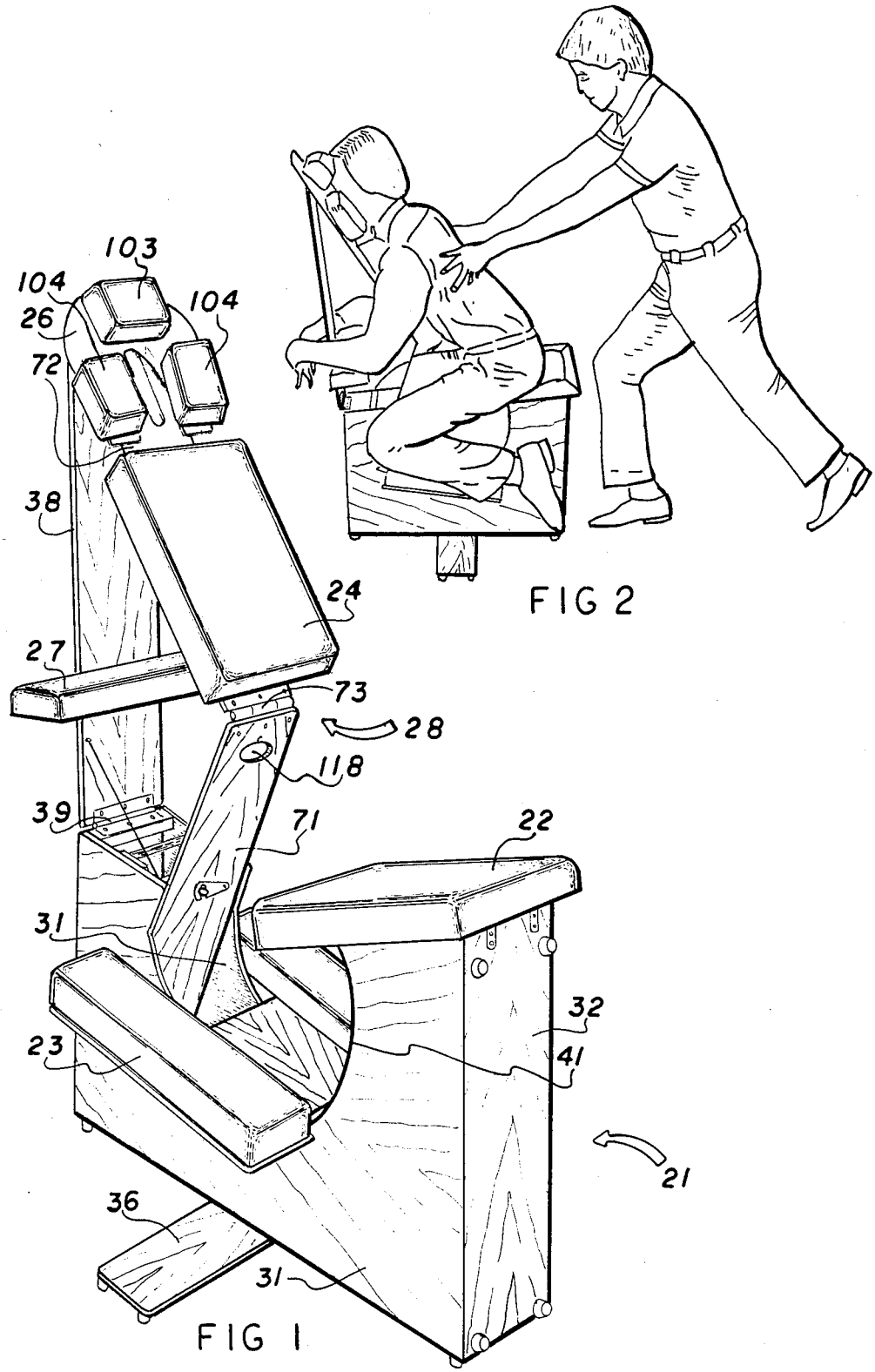
FIG. 1 is a perspective view of the knock-down, portable chair construction of the present invention.
FIG. 2 is a side elevation of the chair construction of FIG. 1, shown in use supporting a person receiving a massage.

The major components of the knock-down chair of the invention include a seating member 22 on which the person sits, a leg rest member 23 to support the lower legs of the person off the ground, a chest support assembly 24 to support the thoracic portion of the person, a face cradle 26 to support the face of the person, and an arm support 27 upon which the person may rest the arm, all as shown in FIG. 2. A hinged brace assembly 28 is also provided to support the chest support assembly 24 and the face cradle 26. All of the components 22–28 are dimensioned to be stored within the case 21.

Figure 16:
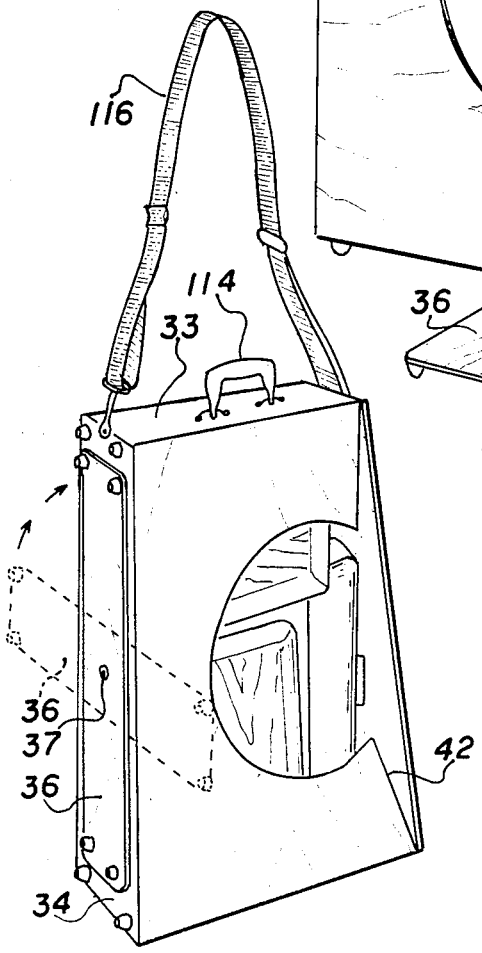
FIG. 16 is a perspective view of the case of the present invention standing on end, with the chair components packed therein and the lateral stabilizer retracted.

The case 21 is generally rectangular in configuration, with a pair of side walls 31 and opposed end walls 32 and 33 extending orthogonally therebetween. A bottom panel 34 is rigidly joined to the side and end walls, as shown in FIG. 16, and a lateral brace 36 is rotatably secured to the bottom panel 34 by means of a pivot pin 37. A top panel or lid 38 is joined to the upper edge of the end wall 33 by a hinge 39, the top panel being pivotable from the open position of FIGS. 1–4 to a closed position in which the distal end of the top panel rests upon the upper edge of the end wall 32. The side walls 31 include large arcuate cutout portions 41 having a generally circular configuration opening to the upper edges of medial portions of the side walls. The side walls 31 also include upper edge portions 42 sloping obliquely downwardly from the end wall 32 to the cutouts 41.

Figure 9:
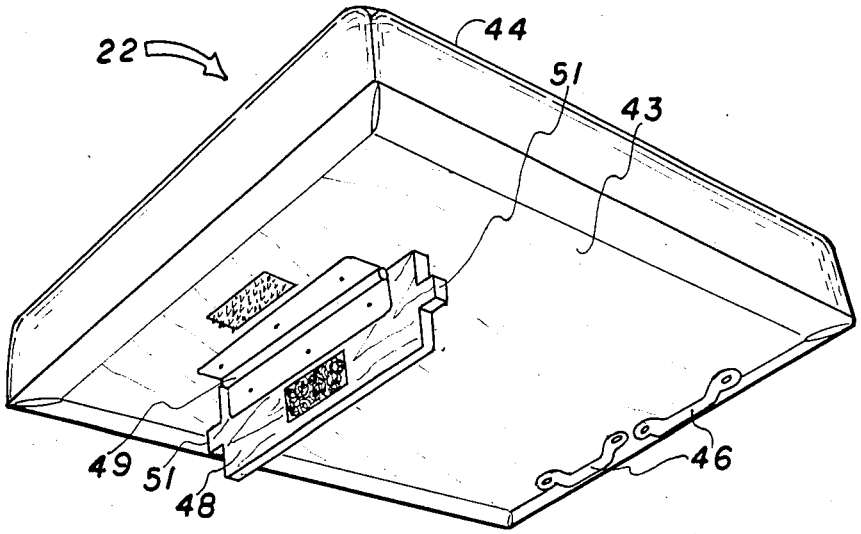
FIG. 9 is an enlarged, bottom perspective view of the seat member of the present invention.

The upper edge portions 42 are disposed to support the seat member 22, as shown in FIGS. 8 and 9. The seat member 22 includes a rigid panel 43 wider than the spacing of the side walls, and including an upholstered, padded upper surface 44. A pair of brackets 46 are secured to one edge of the panel 43, and disposed to pivotally and releasably engage a pair of hook members 47 joined to the upper edge of the end wall 32. The seat member also includes an adjustment bar 48 joined to the panel 43 by a laterally extending hinge 49. The lateral dimension of the bar 48 is slightly less than the spacing of the side walls, and it is hinged along a lateral axis by hinge 49 to pivot and extend between the side walls when the seat 22 is pivoted about the hinge members 47 to rest on the upper edges 42 of the side walls.

Figure 8A:
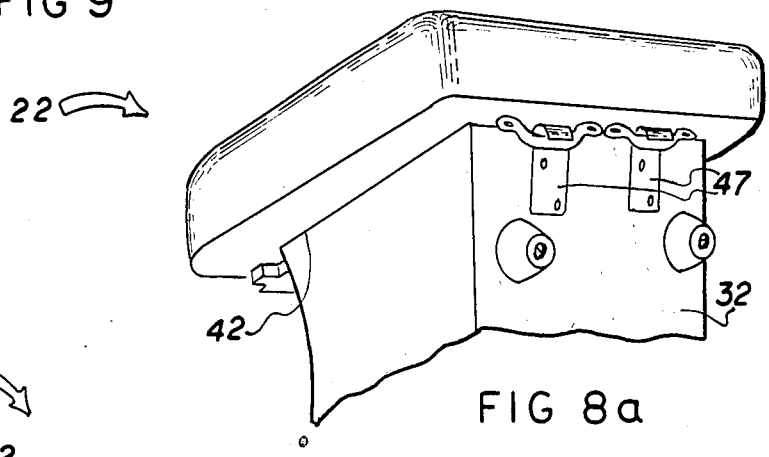
FIG. 8*a* and 8*b* are enlarged, detailed perspective views of the seat member assembled to the case of the present invention, shown in the raised and lower positions.
Figure 8B:
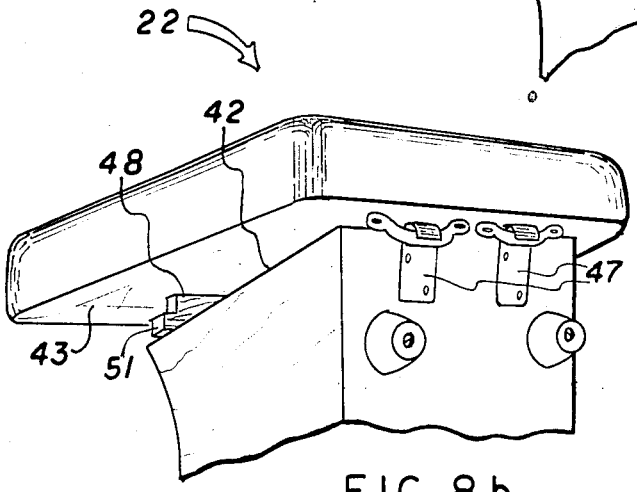

The bar 48 also includes lateral tabs 51 extending from opposed ends of the bar and disposed to impinge upon the upper edges 42 when the bar is pivoted outwardly to extend downwardly from the lower surface of the panel 43. Thus the bar 48 can serve to raise the inner end of the seat member 22 by supporting it on the tabs 51., as shown in FIG. 8*b*. Alternatively, the bar may be pivoted flat against the lower surface of the panel 43, in a position in which both the tabs and the bar itself clear the side walls and the lower surface of the panel 43 impinges directly on the edges 42, disposing the seat at an greater angle with respect to horizontal (FIG. 8*a*). A pair of hook and loop fabric fastener patches 53 are secured on opposed portions of the bar 48 and the panel 43, to retain the bar in the folded, lower seat angle position.

Figure 3:
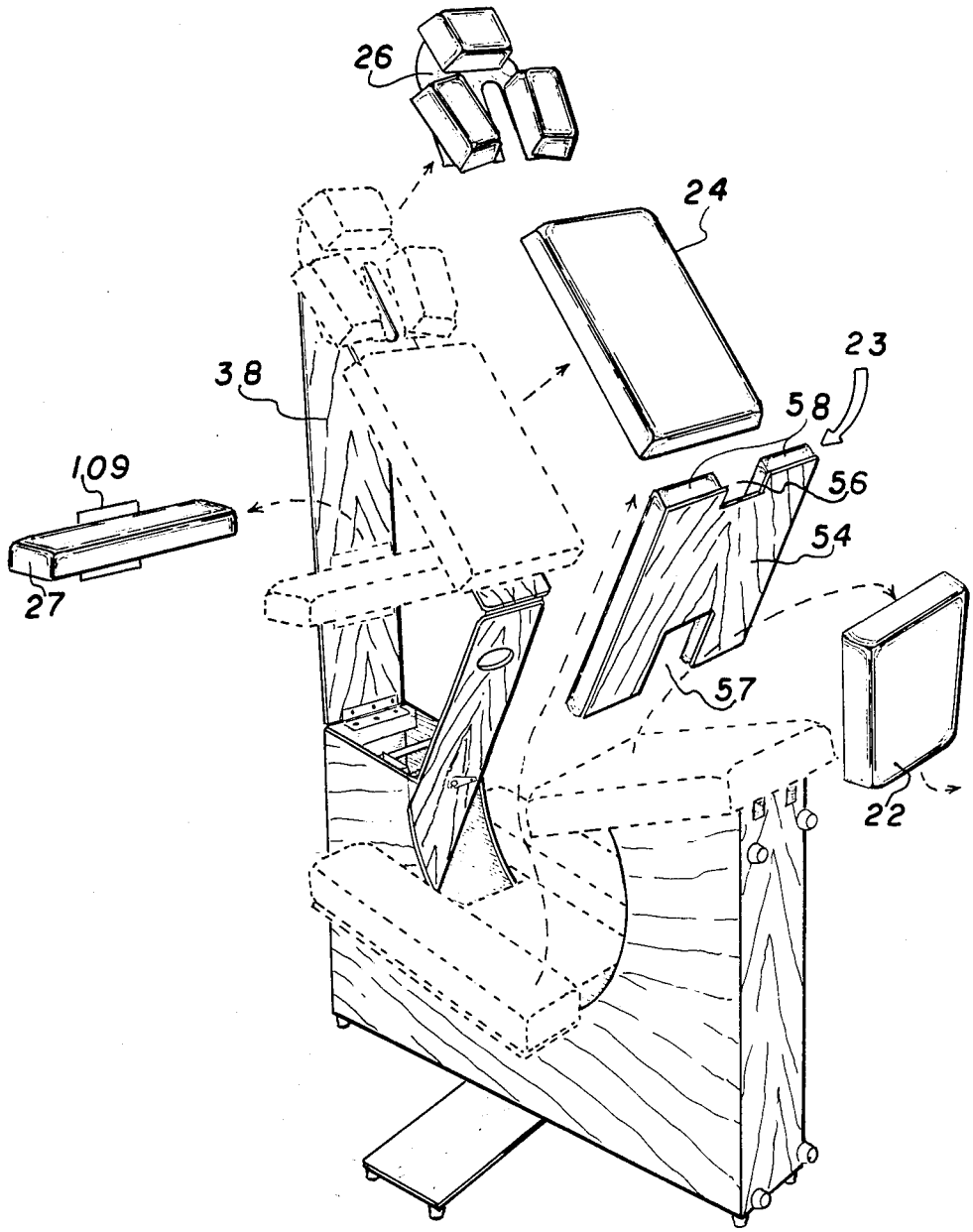
FIG. 3 is an exploded assembly view of the major components of the knock-down, portable chair construction of the present invention.
Figure 4:
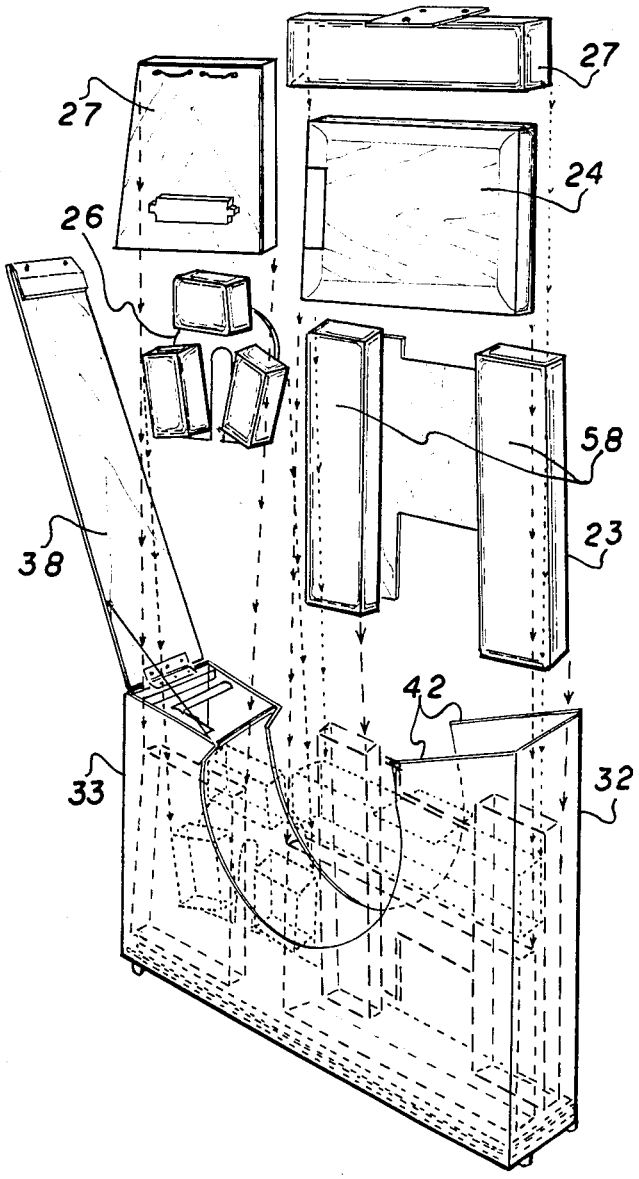
FIG. 4 is an exploded packing view of the major components of the knock-down, portable chair construction of the present invention.

The leg rest 23, shown in FIG. 3, for example, is comprised of a rigid panel 54 having a shallow slot 56 in one end edge, and a deeper slot 57 extending into the opposed end edge. The slots 56 and 57 are aligned along a longitudinal axis, and given sufficient width to straddle the side walls 31, particularly within the arcuate cutouts 41 of the side walls. Disposed on laterally opposed sides of the slots 56 and 57 are a pair of longitudinally oriented, laterally outwardly extending leg cushions 58.

Figure 5:
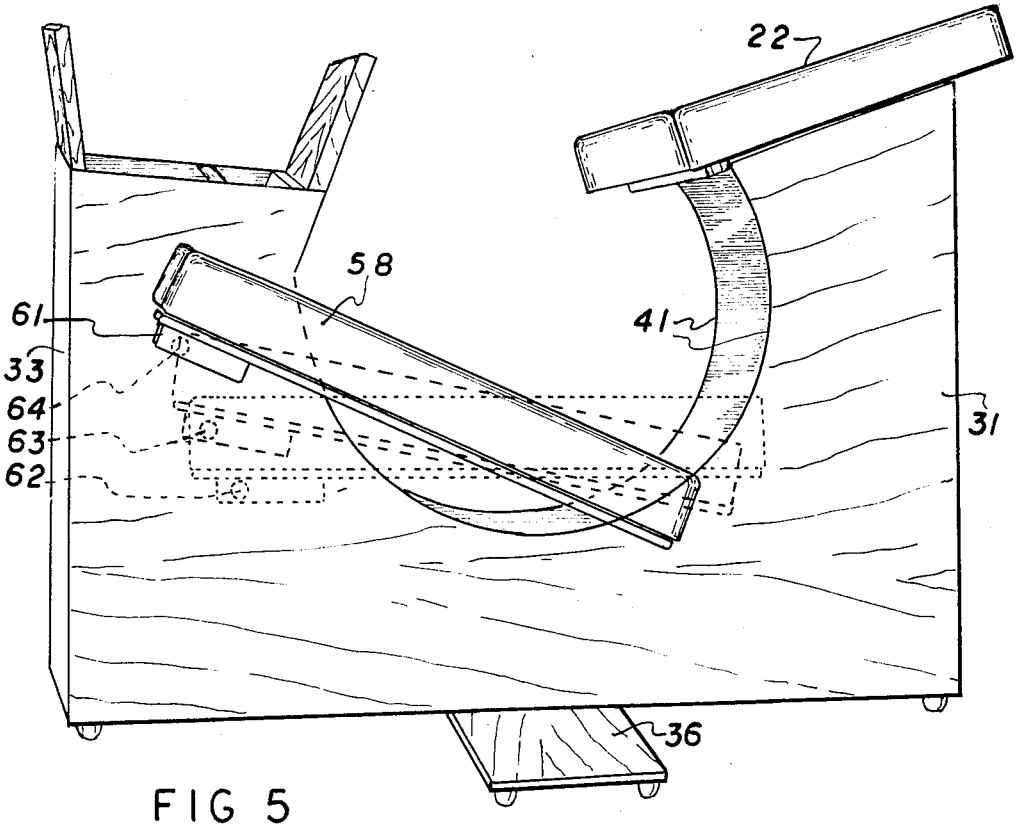
FIG. 5 is a perspective side elevation of the case of the present invention, shown with the seat member and leg rest assembled thereto.
Figure 6:
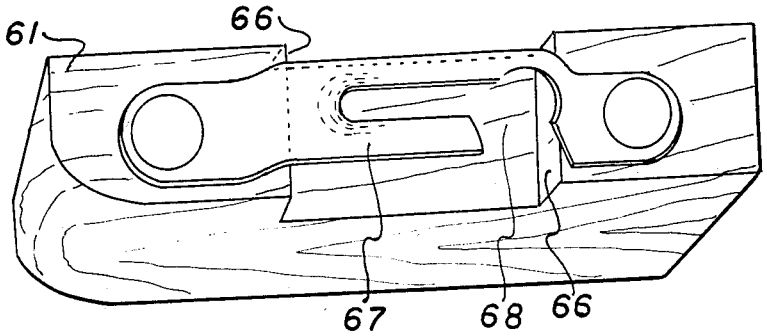
FIG. 6 is an enlarged, detailed perspective view of a mounting block of the leg rest of the present invention.

With regard to FIGS. 5 and 6, the leg rest is received within the arcuate cutouts 41, with the cushion portions 58 straddling the side walls. The forward edge of the leg rest is provided with a pair of mounting blocks 61 disposed at opposite sides of the outer opening of the channel 57, and extending downwardly from the lower surface of the panel 54. A plurality of mounting studs are secured to the side walls in laterally opposed pairs 62, 63, and 64, extending outwardly from the side wall. The pairs 62–64 are arrayed in an arc generally parallel to the adjacent portion of the arcuate cutout edges 41, and spaced between the arcuate edges and the adjacent upper end wall 33. Each mounting block 61 includes a channel 66 extending into the inner surface thereof. The channel 66 is dimensioned to receive the head of a mounting stud 62–64 with clearance. A bracket strap 67 extends across the opening of the channel 66, and is provided with a detent slot 68 dimensioned to receive the shank of one of the mounting studs. (Such hardware is known in the prior art.) This engagement secures the forward edge of the leg rest at a fixed height, and permits the leg rest to pivot about the particular pair of studs engaged. The leg rest pivots gravitally to rest with the inner end of the slot 56 impinging on the arcuate edges 41. The leg rest thus can be secured at any of three chordal angles, as shown in full line and phantom line in FIG. 5, to accommodate individuals of varying heights.

It may be appreciated that the seat 22, in conjunction with the leg rest 23, provides an arrangement to support a person seated on the member 22 with the lower legs supported on the cushions 58 of the leg rest 23. Furthermore, the arcuate cutouts 41 not only provide support for the lower rear edge of the leg rest, it also provides clearance for skirts and dresses of female massage clients.

Figures 10, 11:
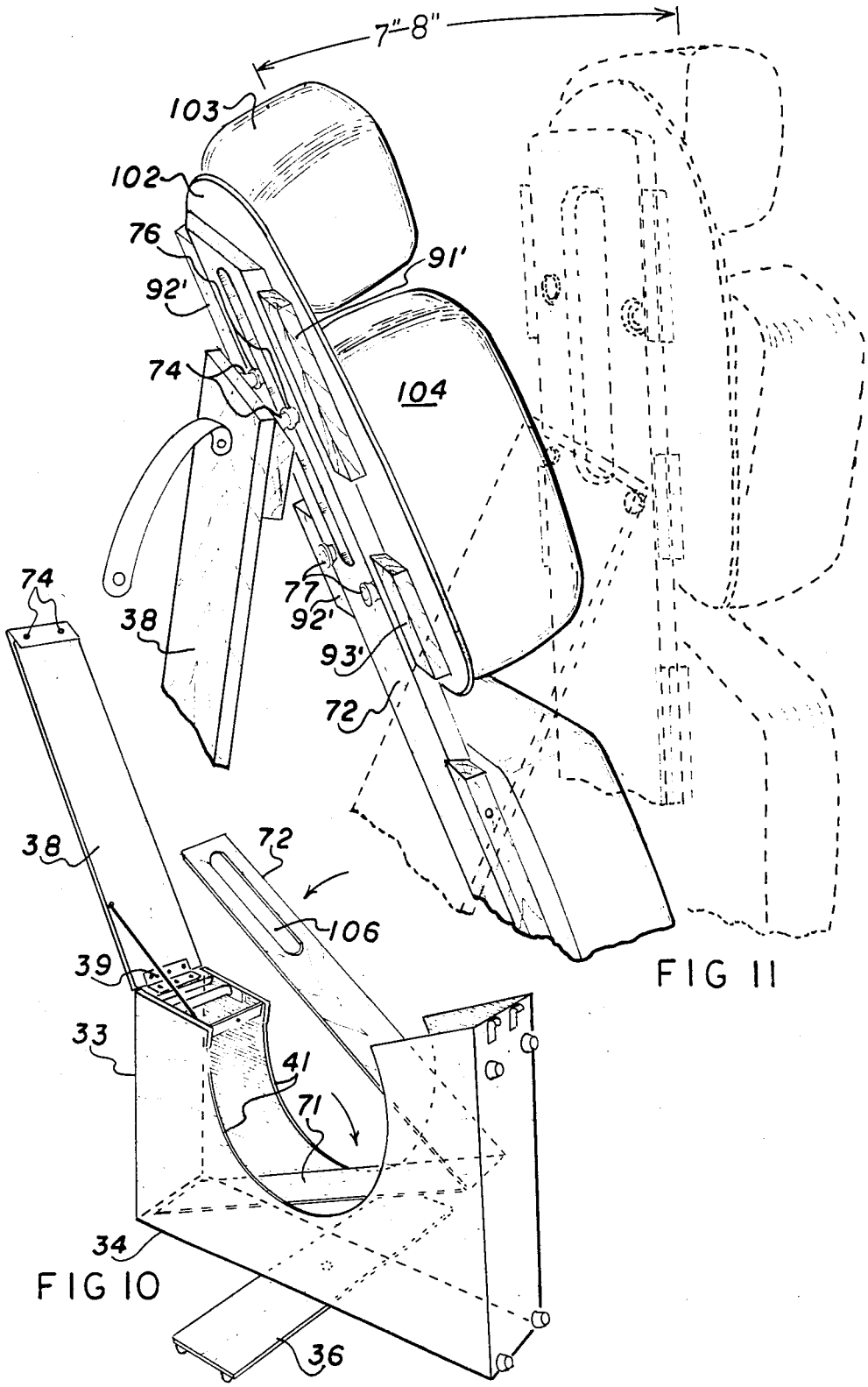
FIG. 10 is a perspective view of the case of the present invention, showing the hinged brace pivoting upwardly and outwardly therefrom.
FIG. 11 is an enlarged, detailed perspective view of the face rest and brace assembly of the present invention.

Another important component of the present invention is the hinged brace assembly 28, which is provided to support the chest support 24 and the face cradle 26 in the erect position depicted in FIGS. 1–3. The assembly 28 includes a lower panel 71 joined to an upper panel 72 by a hinge 73. As shown in FIG. 10, the lower panel is stored within the case directly atop the bottom panel, the lower end abutting the end wall 33 and the hinge abutting the end wall 32, with the panel 72 directly over the panel 71 in vertically stacked relationship. After the lid 38 is opened and the other components removed, the brace assembly 28 is pivoted out of the case and joined at the upper ends of each to form a quasi-trangular vertical support structure. With regard to FIG. 11, the free end of the lid 38 includes a pair of laterally spaced snap fasteners 74, and the bottom surface of the panel 72 is provided with two pair of laterally spaced, mating snap fasteners. One pair 76 is disposed adjacent to the upper end of the panel 72, and the other pair 77 are spaced medially therefrom. Either pair 76 or 77 may be joined to the snap fasteners 74 to join the brace assembly 28 to the lid 38 in either the lower position or upper position, respectively, as shown respectively in full line and phantom line in FIG. 11.

Figure 7:
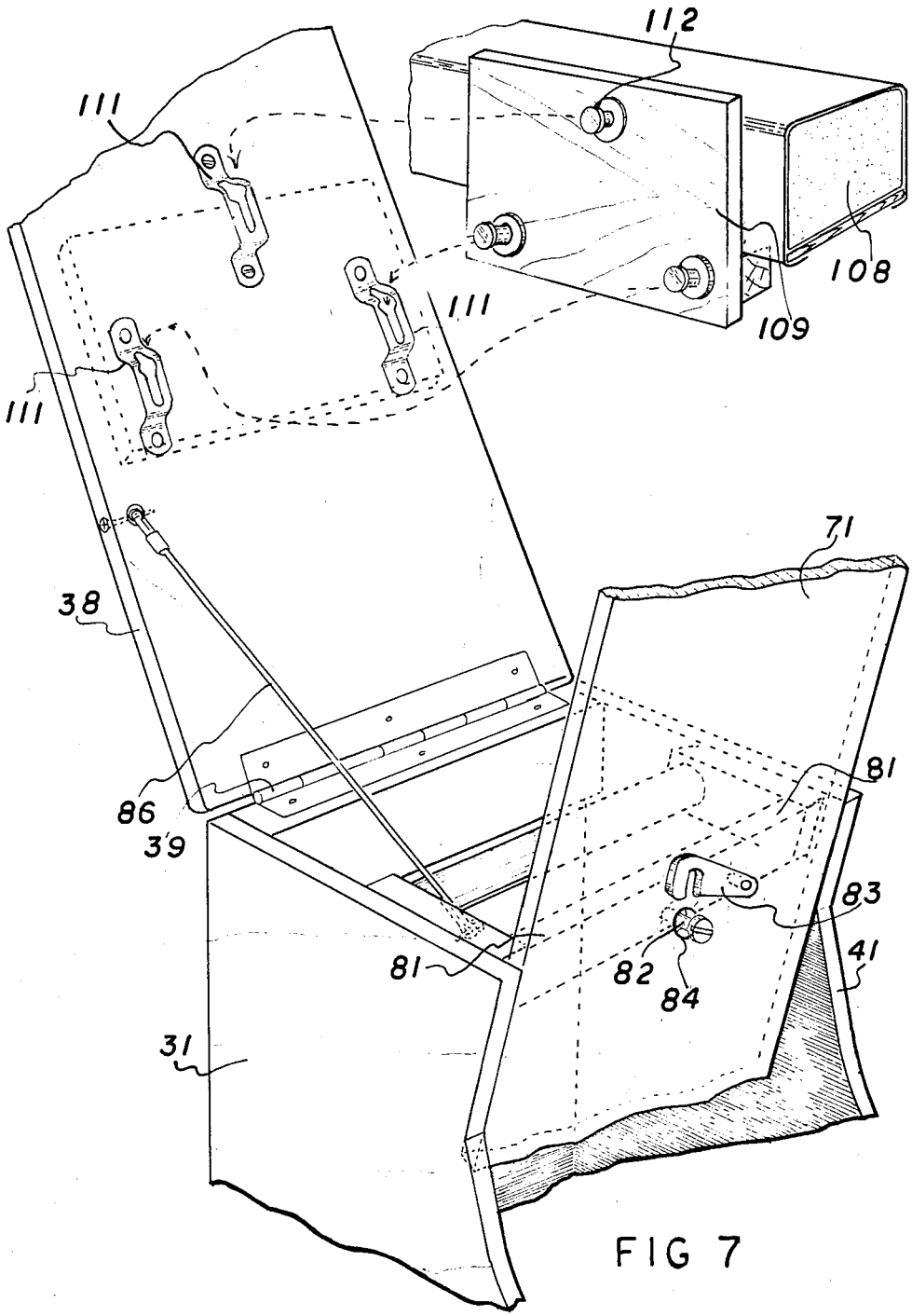
FIG. 7 is an enlarged, detailed perspective view of the brace assembly lock and arm rest mounting of the present invention.

The chair construction includes a latch arrangement to rigidly connect the lower panel 71 to the case in the upright position. With reference to FIG. 7, the invention includes a cross bar 81 extending between the side walls 31 at the intersection of the arcuate cutouts 41 and the top edges of the side walls. The bar 81 is disposed to be impinged upon by the panel 71 when in the erected position. A screw 82 extends from the bar 81, and is oriented to pass through a hole 84 in the panel 71. Pivotally joined to the panel 71 adjacent to the hole 84 is a latch 83, which is adapted to engage the head of the screw 82 to retain the panel abutting the bar 81. Thus when the brace assembly 28 is shifted between the two positions shown in FIG. 11, only the upper panel 72 changes angular orientation.

Furthermore, a flexible tether 86 is secured between a lower portion of the lid 38 and an interior surface of a side wall 31, as shown in FIG. 7. The tether limits the outward and upward rotation of the lid 38 about the hinge 39, so that the lid cannot travel past its approximate engagement angle with the brace assembly.

Figure 12:
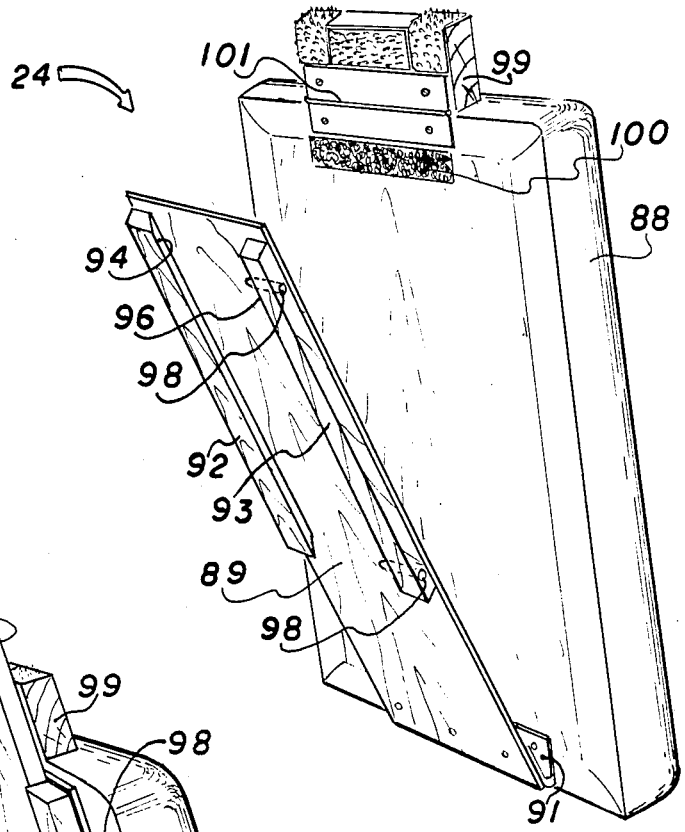
FIG. 12 is a perspective bottom view of the chest support assembly of the present invention.
Figure 13:
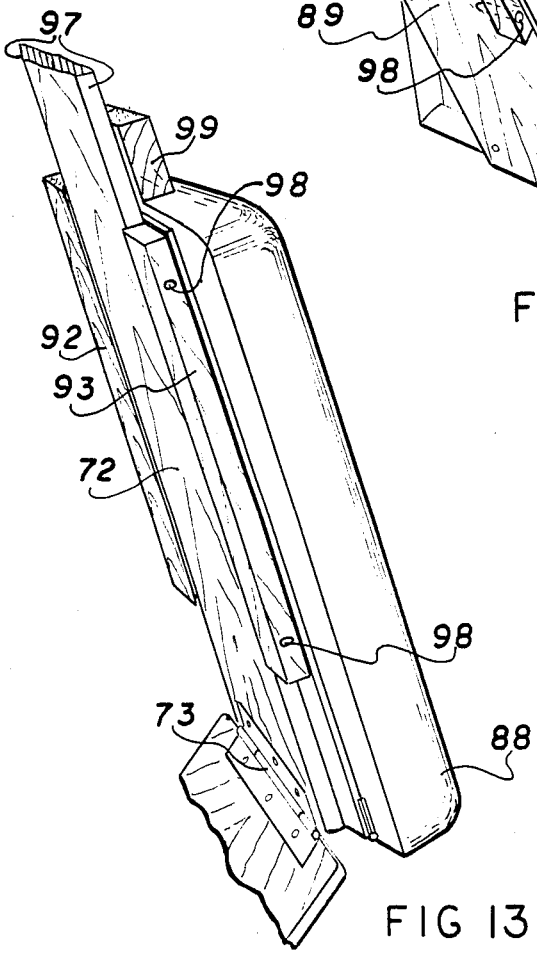
FIG. 13 is a perspective view of the brace assembly of the present invention with the chest support joined thereto in the lower position.

The chest support assembly 24, shown in detail in FIGS. 12 and 13, includes a rigid rectangular panel 87 having an upholstered, padded assembly 88 secured to the upper surface thereof. A mounting panel 89 is secured to the bottom surface of the panel 87 by a hinge 91 joining confronting end edge portion of the two panels. Extending along opposed edges of the panel 89 are a pair of rails 92 and 93, the rails being spaced to receive therebetween the upper panel 72 of the hinged brace assembly. The rails 92 and 93 include interior, confronting surfaces 94 and 96, the surface 94 being chamfered inwardly and the surface 96 extending generally orthogonally from the surface of the panel 89.

The upper panel 72 of the hinged brace assembly is provided with opposed edges 97 which are beveled to taper downwardly. The interior surface 94 of the rail 92 impinges in complementary fit fashion on the respective edge 97, as shown in FIG. 13. A pair of spring-biased bullet detents 98 extend through the rail 93 to impinge on the respective edge 97 in frictional, sliding fashion. The rails thus grip the edges 97 and secure the chest support to the panel 72, while permitting sliding adjustment of the position of the chest support. The chest support may be removed from the hinged brace by sliding it off of the upper end of the panel 72.

Figure 14:
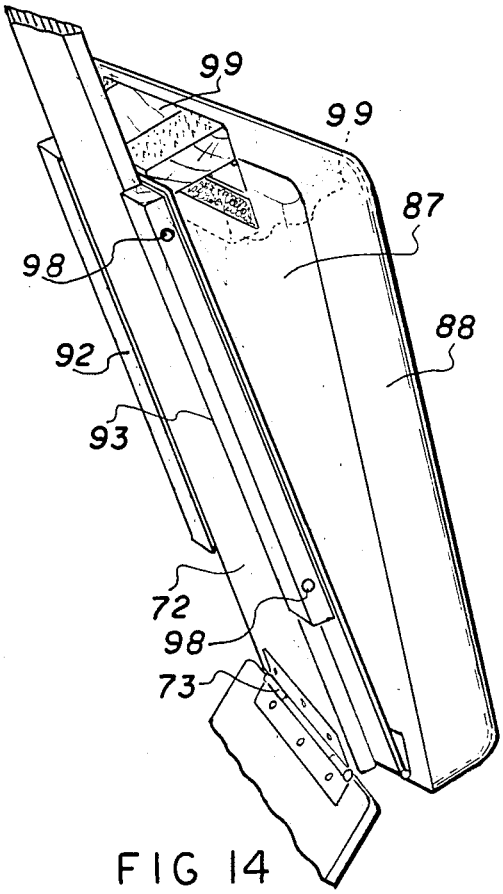
FIG. 14 is a perspective view of the brace assembly of the present invention with the chest support joined thereto in the raised position.

A fabric fastener patch 100 is secured to the panel 87, and strips of complementary fabric fastener (hook and loop) are joined to the confronting surface of the panel 89 to join the panels 87 and 89, as shown in FIG. 13. An adjustment block 99 is joined to the upper end of the panel 87 by a hinge 101, and positioned to be selectively pivotable between the panels 87 and 89 to define angular spacing therebetween, as shown in FIG. 14. The block 99 is provided with appropriate fabric fastener patches to maintain the positions shown in full line and phantom line in FIG. 14. Thus the chest support is angularly adjustable with respect to the panel 72, to accommodate individuals of differing physiognomy. Furthermore, the chest support may be secured in inverted (upside-down) fashion on the panel 72, using the rails 92 and 93 as described above, to further increase the angular adjustability of the chest support.

The face cradle 26, shown in FIGS. 1 and 11, comprises a panel 102 having an inverted U configuration. A cushion 103 is secured at the base of the U shape, and a pair of cushions 104 is secured to the legs of the U shaped panel. The panel 102 includes rail segments 92' and 93' extending from the bottom surface thereof and functioning to retain the face cradle in slidable fashion on the upper panel 72, as described above with respect to the chest support. It should be noted that the open area between the cushions 104 provides clearance for breathing by the person seated on the chair. Furthermore, as shown in FIG. 10, a longitudinal slot 106 is formed in the upper panel 72, so that the opening in the face cradle is in registration with the slot 106. This conjunction permits air and light to reach the face of the seated person, even while the face is supported during massage.

The arm rest 27 comprises a generally laterally extending upholstered member 108, with a mounting plate 109 joined to a central portion thereof, as shown in FIG. 7. A trio of mounting brackets 111 are secured in triangular array to the inner surface of the lid 38 adjacent to the hinge 39. A trio of mounting studs 112 extend from the plate 109 in similar triangular array, and are dimensioned to be removably retained by the brackets 111.

To disassemble the chair construction of the present invention, the face cradle 26 and the chest support 24 are slidably removed from the upper end of the panel 72, the seat 22 is pivoted upwardly and removed from the hook members 47, and the seat is removed. The leg rest mounting blocks are released from engagement with the mounting studs 62–64, and removed from the cutout portion 41. The arm rest 27 is then released from the brackets 11. Next, the latch 83 is released from the screw 82, and the top of the upper panel 72 is pushed toward the end wall 32 to release the snaps 74. The hinged brace assembly 28 is then collapsed into the bottom of the case 21, as shown in FIG. 10.

Figure 15:
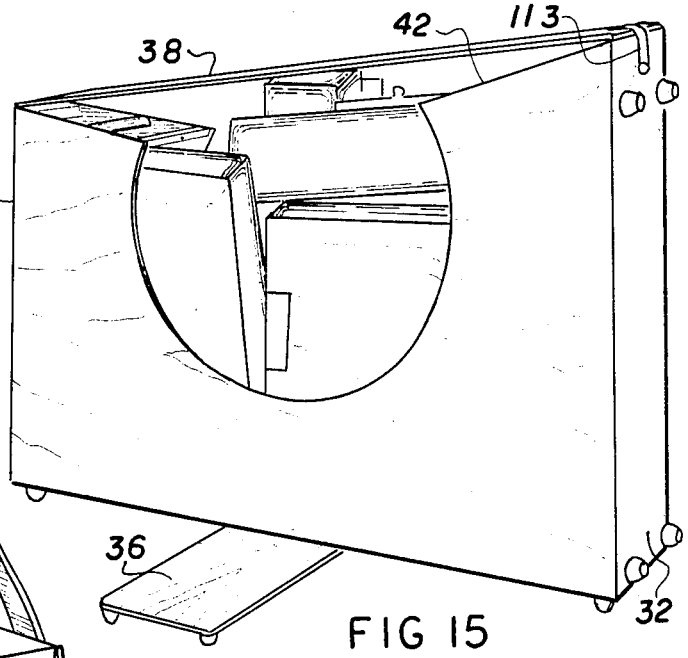
FIG. 15 is a side perspective of the case of the present invention with the chair components packed therein and the lateral stabilizer deployed.

As noted previously, all of the components 22, 23, 24, 26, and 27 are dimensioned to fit inside the case. A preferred packing order is described with reference to FIG. 4, although other packing configurations are possible. The face cradle 26 and the seat member 27 are placed in the case, upholstered sides facing together, and disposed adjacent to the end wall 33. The chest support 24 is then placed in the case between the seat member 27 and the end wall 32, with the upholstered surface facing into the case. The leg rest 23 is oriented with the cushions 58 extending horizontally, the arm rest 27 is placed between the cushions 58, and both components 23 and 27 are inserted into the case with their upholstered sides facing the chest support and disposed between the face cradle and the end wall 32. The lid 38 may then be closed, as shown in FIG. 15, and secured by a strap 113 releasably secured between the free end of the lid and the end wall 32. The case 21 is placed on the end wall 32, and the lateral brace 36 rotated to it retracted position, as shown in FIG. 16. A handle 114 and shoulder strap 116 may be secured to either end wall to facilitate carrying of the chair in its compact, disassembled configuration.

It should also be noted that the chair of the present invention has been designed to be adapted to support an individual sitting on the seat member 22 with the back supported against the chest support 24, and the feet resting directly on the ground. For this configuration, the upper panel 72 is raised to the phantom line position of FIG. 11, the chest support is in the raised position of FIG. 14, and the seat member is in the raised position of FIG. 8*b*. This position facilitates massage of the shoulders, chest, and legs.

With a massage client supported facing the face cradle and chest support, as shown in FIG. 2, the head and neck are aligned with the back and spine; that is, the spinal column is arched and curved slightly forwardly, and the vertibrae are all non-rotated. This position is an improvement over the support provided by a traditional massage table, in that a client lying on a table generally rests the head on one side of the face, and the entire cervical portion of the upper spine is twisted. Using the chair of the present invention, the upper spine is not rotated and also readily available for massage.

The preferred embodiment described above, when fashioned of wood or plywood panel materials, weighs approximately 25 pounds, and is thus easily portable. The case, including all components stored therein, is only 6.5 inches in width (between side walls), and 28 inches in length. The collapsed height is approximately 19 inches, and the erected height is 46 inches. The collapsed configuration is approximately the same size as a large suitcase. Furthermore, an experienced individual can erect or disassemble and pack the entire chair in less than one minute. Thus the present invention provides the portability and ease of use which permits the delivery of massage services to clients, thus opening up untapped markets for massage and bodywork services.

It should be noted that the lower panel 71 of the hinged brace assembly 28 is provided with a handle hole 118 extending through an upper end portion thereof. The handle 118 permits lifting and carrying the chair in the erected configuration, due to the fact that the hole 118 is directly above the center of gravity of the assembled chair.

We claim:

1. A portable, knock-down chair construction, comprising; a portable case, a seat member, means for removably supporting said seat member on a portion of said case, a brace assembly extendable from a storage position within said case to an extended support position extending out of said case, a chest support, means for securing said chest support to said brace assembly in the extended support position; said seat member, said brace assembly, and said chest support dimensioned to be stored together within said case; said brace assembly including upper and lower rigid brace members; means for joining confronting ends of said brace members in hinged relationship; said chest support including a padded member, said upper brace member including opposed, longitudinally extending edges, and said padded member including means for engaging said edges in frictional, sliding fashion; further including a face cradle disposed adjacent to said chest support in the extended position, said face cradle also including means for engaging said edges of said upper brace member in frictional, sliding fashion, said face cradle being dimensioned to be stored within said case with said chest support, said brace assembly, and said seat member, said face cradle including a generally U-shaped panel in inverted position, and a trio of cushions secured to the base and each leg of said U configuration, and said upper brace member including a slot extending therethrough, said slot being disposed in registration with the space between said legs of said U-shaped panel of said face cradle.

2. A portable, knock-down chair construction, comprising; a portable case, a seat member, means for removably supporting said seat member on a portion of said case, a brace assembly extendable from a storage position within said case to an extended support position extending out of said case, a chest support adapted to be secured to said brace assembly in the extended support position, said seat member, said brace assembly, and said chest support dimensioned to be stored together within said case, said brace assembly including upper and lower rigid brace members, and means for joining confronting ends of said brace members in hinged relationship; said case including a top panel pivotally joined thereto, and means for releasably joining said upper brace member and said top panel together to form a rigid support structure extending upwardly from said case; an arm rest, means for releasably securing said arm rest to said top panel of said case, said arm rest being dimensioned to be stored within said case with said chest support, said brace assembly, and said seat member.

3. A portable, knock-down chair construction, including; a case having a pair of opposed side walls and a pair of end walls extending therebetween, a seat member, hinge means for releasably and pivotally joining said seat member to one of said end walls with said seat member disposed to impinge on upper edge portions of said side walls, said seat member being dimensioned to be stored within said case; further including a brace assembly extendable from a storage position within said case to an extended support position extending out of said case, a chest support, means for removably securing said chest support to said brace assembly in the extended position, said seat member, said brace assembly, and said chest support dimensioned to be stored together within said case in the knock-down configuration; said case including a top panel pivotally joined to the other end wall and movable from a closed to an open position, means for releasably joining together said brace assembly in the extended position and said top panel in the open position to form a rigid support structure extending upwardly from said case, and means for securing said top panel in the closed position to said one end wall in the knock-down configuration to form a closed case.

4. The portable, knock-down chair construction of claim 3, further including a pair of arcuate cutout portions, each disposed in a medial portion of one of said side walls in lateral opposition to the other, and leg rest means adapted to be supported by said arcuate cutout portions.

5. The portable, knock-down chair construction of claim 4, wherein said leg rest means includes a laterally extending panel extending through said arcuate cutout portion, and leg cushions joined to laterally opposed ends of said laterally extending panel and disposed outwardly of said side walls of said case.

6. The portable, knock-down chair construction of claim 5, further including adjustment means for selectively varying the angle of said laterally extending panel with respect to horizontal.

7. The portable, knock-down chair construction of claim 3, wherein said brace assembly includes upper and lower rigid brace members disposed to form a generally triangular rigid support structure with said top panel and said one end wall, and hinge means for joining confronting ends of said upper and lower members in pivoting relationship.

8. The portable, knock-down chair construction of claim 7, further including latch means for releasably and rigidly joining said lower brace member to said case when said brace assembly is in said extended position.

9. The portable, knock-down chair construction of claim 8, further including handle means joined to said lower brace member to facilitate carrying of said chair construction in said extended position.

10. The portable, knock-down chair construction of claim 7, further including an arm rest member, means for releasably securing said arm rest member to the inside surface of said top panel in the open position with said arm rest member extending laterally outwardly of said side walls of said case, said arm rest member being dimensioned to be stored within said case with said brace assembly, said seat member, and said chest support.

11. The portable, knock-down chair construction of claim 7, further including a face cradle, means for securing said face cradle to said upper brace member in the extended position in slidably positionable fashion, said face cradle being dimensioned to be stored in said case with said brace assembly, said seat member, and said chest support.

12. The portable, knock-down chair construction of claim 7, further including adjustment means for selectively varying the angle of said chest support with respect to said upper brace member.

13. The portable, knock-down chair construction of claim 3, further including adjustment means for selectively varying the angle of said seat member with respect to horizontal.

14. The portable, knock-down chair construction of claim 3, further including a lateral stabilizing means extendable from said case outwardly of said side walls in ground-engaging fashion.

15. A portable, knock-down chair construction, including; a case having a bottom wall and a pair of opposed side walls and a pair of end walls extending upwardly from said bottom wall, said bottom wall, side walls, and end walls joined at confronting edges to define an upwardly opening, box-like container; a seat member, means for releasably supporting said seat member atop one of said end walls and adjacent upper edge portions of said side walls, a top panel hingably secured to said other end wall, means for releasably securing said top panel in an upwardly extended position from said other end wall, a chest support member and a face support member, means for releasably supporting said chest support member and said face support member by said top panel in said upwardly extended position, said seat member, chest support member, and face support member being dimensioned to be stored together within said container.

16. The portable, knock-down chair construction of claim 15, wherein said means for releasably securing said top panel in an upwardly extended position from said other end wall includes a brace assembly, said brace assembly comprising upper and lower brace members, means for hingably securing together the lower end of said upper brace member and the upper end of said lower brace member, means for pivotally securing said brace members within said container in movable fashion from a collapsed disposition within said container to an erected position extending upwardly and outwardly from said upwardly opening container, and means for releasably securing said top panel in said upwardly extended position to said upper brace member in said erected position.

17. The portable, knock-down chair construction of claim 15, further including leg rest means comprising at least one leg rest member, and means for releasably securing said leg rest member to said container with at least a portion of said leg rest member extending outwardly from said side walls, said leg rest member being dimensioned to be stored within said container together with said chest support member, said face support member, and said seat member.

18. A portable, knock-down chair construction, including; a case having a bottom wall and a pair of opposed side walls and a pair of end walls extending upwardly from said bottom wall, said bottom wall, side walls, and end walls joined at confronting edges to define an upwardly opening, box-like container; a seat member, means for releasably supporting said seat member atop one of said end walls and adjacent upper edge portions of said side walls, brace assembly means secured within said container and being pivotally movable from a collapsed disposition within said container to an erected position extending upwardly and outwardly from said upwardly opening container, and means for releasably maintaining said brace assembly means in said erected position; a chest support member and a face support member, means for releasably supporting said chest support member and said face support member by said brace assembly means in said upwardly extended position, said seat member, chest support member, face support member, and said brace assembly means in said collapsed disposition being dimensioned to be stored together within said container.

19. The portable, knock-down chair construction of claim 18, wherein said brace assembly means comprises upper and lower brace members, means for hingably securing together the lower end of said upper brace member and the upper end of said lower brace member, means for securing the lower end of said lower brace member within said container, said means for releasably supporting said chest support member and said face support member by said brace assembly means in said upwardly extended position including means for securing said chest support member and said face support member to said upper brace member.

20. The portable, knock-down chair construction of claim 19, further including a leg rest member adapted to be secured to said case in a position to support the legs of a person seated on said seat member, said leg rest member dimensioned to be stored within said case with said chest support, said brace assembly, and said seat member.

21. The portable, knock-down chair construction of claim 19, wherein said chest support includes a padded member, said upper brace member includes opposed, longitudinally extending edges, and said padded member includes means for engaging said edges in frictional, sliding fashion.

22. The portable, knock-down chair construction of claim 21, said face support member comprising a face cradle disposed adjacent to said chest support in the extended position, said face cradle also including means for engaging said edges of said upper brace member in frictional, sliding fashion, said face cradle being dimensioned to be stored within said case with said chest support, said brace assembly, and said seat member.

23. The portable, knock-down chair construction of claim 22, wherein said face cradle includes a generally U-shaped panel in inverted position, and a trio of cushions secured to the base and each leg of said U configuration.

24. The portable, knock-down chair construction of claim 23, wherein said upper brace member includes a slot extending therethrough, said slot being disposed in registration with the space between said legs of said U-shaped panel of said face cradle.

25. The portable, knock-down chair construction of claim 19, wherein said case includes a top panel pivotally joined thereto, and means for releasably joining said upper brace member and said top panel together to form a rigid support structure extending upwardly from said case.

26. The portable, knock-down chair construction of claim 25, further including latch means for releasably securing said lower brace member rigidly to said case when said brace is in the extended position.

27. The portable, knock-down chair construction of claim 25, further including an arm rest adapted to be releasably secured to said lid of said case in the extended position, said arm rest being dimensioned to be stored within said case with said chest support, said brace assembly, and said seat member.

* * * * *